US006719859B2

(12) United States Patent
Bergsma

(10) Patent No.: US 6,719,859 B2
(45) Date of Patent: Apr. 13, 2004

(54) HIGH STRENGTH ALUMINUM BASE ALLOY

(75) Inventor: S. Craig Bergsma, The Dalles, OR (US)

(73) Assignee: Northwest Aluminum Company, The Dalles, OR (US)

( * ) Notice: Subject to any disclaimer, the term of this patent is extended or adjusted under 35 U.S.C. 154(b) by 167 days.

(21) Appl. No.: 10/075,983

(22) Filed: Feb. 15, 2002

(65) Prior Publication Data

US 2003/0155049 A1 Aug. 21, 2003

(51) Int. Cl.[7] ..... C22F 1/043

(52) U.S. Cl. ..... 148/549; 148/698; 148/700; 164/900; 164/113

(58) Field of Search ..... 148/549, 698, 148/700; 164/900, 76.1, 71.1, 113; 420/534, 535

(56) References Cited

U.S. PATENT DOCUMENTS

| | | | | |
|---|---|---|---|---|
| 1,595,058 | A | 8/1926 | Pacz | |
| 1,924,727 | A | 8/1933 | Rowe | 75/1 |
| 2,881,439 | A | 4/1959 | Cooper et al. | 75/143 |
| 3,369,591 | A | 2/1968 | Welch et al. | 164/113 |
| 3,716,355 | A | 2/1973 | Wikle et al. | 75/142 |
| 3,761,252 | A | 9/1973 | O'Rourke et al. | 75/141 |
| 4,062,704 | A | 12/1977 | Sperry et al. | 148/32 |
| 4,170,469 | A | 10/1979 | Mori | 75/141 |
| 4,284,429 | A | 8/1981 | Savas | 75/141 |
| 4,571,368 | A | 2/1986 | Fenoglio et al. | 428/654 |
| 4,785,092 | A | 11/1988 | Nanba et al. | 420/540 |
| 4,808,374 | A | 2/1989 | Awano et al. | 420/537 |
| 5,028,393 | A | 7/1991 | Tanaka et al. | 420/531 |
| 5,338,168 | A | 8/1994 | Kondoh et al. | 418/179 |
| 5,415,710 | A | 5/1995 | Shiina et al. | 148/439 |
| 5,523,050 | A | 6/1996 | Lloyd et al. | 420/528 |
| 5,571,346 | A | 11/1996 | Bergsma | 148/550 |
| 5,650,025 | A | 7/1997 | Han | 148/439 |
| 5,837,388 | A | 11/1998 | Doko et al. | 428/654 |
| 5,846,350 | A | 12/1998 | Bergsma | 148/549 |
| 5,879,478 | A | 3/1999 | Loue et al. | 148/438 |
| 5,911,843 | A | 6/1999 | Bergsma | 148/550 |
| 5,925,315 | A | 7/1999 | Bourkhina | 420/530 |
| 6,059,902 | A | 5/2000 | Yoshihara et al. | 148/550 |
| 6,077,363 | A | 6/2000 | Heymes et al. | 148/417 |

OTHER PUBLICATIONS

"Aluminum and Aluminum Alloys", ASM International, (1993), p 292, 296–299.*

* cited by examiner

*Primary Examiner*—George Wyszomierski
*Assistant Examiner*—Janelle Morillo
(74) *Attorney, Agent, or Firm*—Andrew Alexander

(57) ABSTRACT

An improved Si—Cu—Mg—Al base alloy suitable for forming in the semi-solid condition into members such as vehicular members having improved properties.

14 Claims, 2 Drawing Sheets

HIGH STRENGTH ALUMINUM BASE ALLOY

BACKGROUND OF THE INVENTION

This invention relates to aluminum base alloys and more particularly it relates to an aluminum base alloy containing silicon, copper and magnesium and a method of semi-solid forming the aluminum alloy to provide a formed member or product having improved properties.

There is great interest in the use of semi-solid forming of aluminum alloys to improve both yield strength and tensile strength of formed products. The properties of the formed products are strongly influenced by selection of the elements comprising the aluminum alloy.

The references disclose that the properties are improved by different mechanisms. For example, U.S. Pat. No. 1,595,058 discloses an aluminum base alloy containing 3 to 15 wt. % Si, 0.5 to 3 wt. % Cu and 0.25 to 1 wt. % Mn having improved tensile strength, the properties improved by an alkali metal treatment.

U.S. Pat. No. 1,924,727 discloses an aluminum base alloy containing 3 to 8 wt. % Si, 0.5 to 3 wt. % Cu, 0.2 to 1.5 wt. % Mg and 0.3 to 2 wt. % Mn. The alloy is improved by the addition of manganese or nickel.

U.S. Pat. No. 4,808,374 discloses a method for producing aluminum alloy castings and the resulting product having improved toughness. An Al—Si or Al—Si—Cu alloy containing 4 to 24 wt % of silicon, iron and other incidental impurities, the balance being aluminum is melted, and the melt is heated to a temperature between 780° C. and 950° C. The melt is poured into a mold and solidified. Solution heat treatment and aging are then conducted. The process is suitable for an alloy containing 0.25 to 1.4 wt % of iron. In a preferred embodiment, the alloy consists essentially of 6 to 12 wt % Si, 2 wt % Cu, 0.2 to 0.4 wt % Mg and other incidental impurities, the balance being aluminum. The solution heat treatment is preferably carried out by heating between 525°–545° C. for a period of 1 to 5 hours.

U.S. Pat. No. 5,028,393 discloses an Al-based alloy for use as sliding material, superior in fatigue resistance and anti-seizure property consisting, by weight, of 1–10% Zn, 1–15% Si, 0.1–5% Cu, 0.1–5% Pb, 0.005–0.5% Sr, and the balance Al and incidental impurities.

U.S. Pat. No. 5,338,168 discloses an oil pump comprises a casing of aluminum alloy and at least one rotor housed therein. The rotor is produced by powder metallurgy by a rapidly solidified aluminum alloy comprising, by weight, of 5 to 25% of Si, up to 15% of one or more alloy elements selected from the group consisting of 3 to 10% of Fe, 3 to 10% of Ni and 1 to 8% of Cr, and the balance of Al and inevitable impurities. The casing may be produced by powder metallurgy or ingot metallurgy with an aluminum alloy consisting essentially, by weight, of 5 to 25%, preferably 5 to 17%, of Si, 1 to 5% of Cu, 0.2 to 1.5% of Mg, 0.2 to 1% of Mn, and the balance of Al and inevitable impurities. The rotor and casing are so combined that the sum of the Si content of said rapidly solidified aluminum alloy for casing and that of said rapidly solidified aluminum alloy for rotor being equal to or more than 15 percent by weight.

U.S. Pat. No. 5,879,478 discloses an aluminum alloy for thixoforming with the composition (by weight): Si: 5%–7.2%, Cu: 1%–5%, Mg<1%, Zn<3%, Fe<1.5%, other elements <1% each and <3% in total, with % Si<7.5-% Cu/3, which, when reheated to the semisolid state to the point at which a liquid fraction ratio between 35 and 55% is obtained, has an absence of non-remelted polyhedral silicon crystals.

U.S. Pat. No. 2,811,439 discloses an aluminum casting alloy containing 2 to 5 wt. % Cu, 1.5 to 2.5 wt. % Fe, 0.2 to 2 wt. % Si, and 0.05 to 0.3 wt. % Ti.

U.S. Pat. No. 4,284,429 discloses an aluminum casting alloy consisting essentially of 5.0% to 22.0% silicon, 0.5 to 7.0% copper, 1.5 to 5.5% magnesium, 2.0 to 8.0% zinc, iron not over 1.35%, manganese not over 0.65%, nickel not over 0.50%, titanium not over 0.20%, and chromium and other residual elements not over 0.15%, balance aluminum.

U.S. Pat. No. 4,785,092 discloses aluminum brazing alloys for assembling aluminum heat exchangers by brazing which consist essentially of 4.5 to 13.5% of Si, from 0.005% to less than 0.1% of Sr and the balance essentially Al and, further, optionally may contain at least one element selected from the group consisting of 0.3 to 3.0% of Mg, 2.3 to 4.7% of Cu and 9.3 to 10.7% of Zn. The aluminum brazing alloys provide high strength brazed joints with highly refined microstructure and brazing operation can be performed in a good condition without causing any detrimental cavity. Such excellent properties make the brazing alloys especially suited for the fabrication of superhigh pressure heat exchangers.

U.S. Pat. No. 5,925,315 discloses an antifrictional aluminum alloy and a method for making an aluminum alloy without lead are provided. The alloy has improved tribological characteristics and a base composition, in weight percent as follows: silicon: 3.0–6.0, copper: 2.0–5.0, zinc: 0.5–5.0, magnesium: 0.25–0.5, nickel: 0.2–0.6, tin: 0.5–5.0, bismuth: 0.1–1.0, iron: up to 0.7, aluminum: essentially the balance.

U.S. Pat. No. 6,059,902 discloses an aluminum alloy containing Si: 1.5–12% (mass % here and hereinafter), Mg: 0.5–6% and, optionally, at least one of Mn: 0.5–2%, Cu: 0.15–3% and Cr: 0.04–0.35% and, further, containing Ti: 0.01–0.1% and the balance of Al and inevitable impurities, in which the average grain size of crystallized grains of Si system compounds is from 2 to 20 tm and an area ratio thereof is from 2 to 12%. The alloy is melted to obtain a cast ingot having DAS (Dendrite Arm Spacing) of 10 to 50 $\mu$m, which is then put to a soaking treatment at 450 to 520° C. and then to extrusion molding. The aluminum alloy has excellent machinability with no addition of low melting metals.

U.S. Pat. No. 5,911,843 discloses a process for casting, thermally transforming and semi-solid forming an aluminum base alloy into an article, the process comprising the steps of: casting a molten body of aluminum base alloy comprising 2 to 7 wt. % Si, 0.3 to 1.7 wt. % Mg, 0.3 to 3 wt. % Cu, 0.05 to 0.4 wt. % Fe, and at least one of the group consisting of 0.01 to 1 wt. % Mn, 0.01 to 0.35 wt. % Cr, max. 0.2 wt. % Ti, max. 0.3 wt. % V to provide a solidified body, the molten aluminum base alloy being solidified at a rate between liquidus and solidus temperatures of the aluminum base alloy to provide a solidified body having a dendritic microstructure.

U.S. Pat. No. 5,846,350 discloses a process for casting, thermally transforming and semi-solid forming an aluminum base alloy into an article, the process comprising the steps of: casting a molten body of aluminum base alloy comprising 2 to 5 wt. % Si, 0.3 to 1.7 wt. % Mg, 0.3 to 1.2 wt. % Cu, 0.05 to 0.4 wt. % Fe, and at least one of the group consisting of 0.01 to 1 wt. % Mn, 0.01 to 0.35 wt. % Cr, max. 0.2 wt. % Ti, max. 0.3 wt. % V to provide a solidified body, the molten aluminum base alloy being solidified at a rate between liquidus and solidus temperatures of the aluminum base alloy to provide a solidified body having a dendritic microstructure. Thereafter, heat is applied to the solidified body to bring it to a superheated temperature of 3° to 50° C. above the solidus temperature of the aluminum base alloy while maintaining the body in a solid shape, effecting thermal transformation of the body having the dendritic structure when the body is heated to above the solidus temperature. The body, having a non-dendritic structure, is formed in a semi-solid condition into the article.

U.S. Pat. No. 5,571,346 discloses a process for casting, thermally transforming and semi-solid forming an aluminum base alloy into an article, the process comprising the steps of: casting a molten body of aluminum base alloy to provide a solidified body, the molten aluminum base alloy being solidified at a rate between liquidus and solidus temperatures of the aluminum base alloy in a range of 5° to 100° C./sec. to provide an entire solidified body having a dendritic microstructure. Thereafter, heat is applied to the solidified body to bring the body to a superheated temperature of 3° to 50° C. above the solidus temperature of the aluminum base alloy while maintaining a body in a solid shape and effecting thermal transformation of the body having the dendritic structure when the entire body is uniformly heated to the superheated temperature. The body having a non-dendritic structure is formed in a semisolid condition into the article.

In spite of these disclosures, there is still a great need for a semi-solid formed member having improved properties such as tensile strength and yield strength properties.

SUMMARY OF THE INVENTION

It is an object of the invention to provide an improved aluminum base alloy suitable for forming in the semi-solid condition into members such as vehicular members having improved properties.

It is another object of the invention to provide an aluminum base alloy member or casting having improved properties in the T5 or T6 condition.

Yet, it is another object of the invention to provide a method for semi-solid forming an aluminum base alloy into articles or members having improved properties.

These and other objects will become apparent from a reading of the specification and claims appended hereto.

In accordance with these objects, there is provided a method of forming an aluminum base alloy member having a globular microstructure contained in a lower melting eutectic matrix. The method comprises providing a body of a semi-solid aluminum base alloy comprising 3.5 to 5.5 wt. % Si, preferably less than 5 wt. % Si, 3.6 to 5 wt. % Cu, 0.35 to 1 wt. % Mg, max. 0.25 wt. % Fe, max. 0.1 wt. % Mn, max. 0.25 wt. % Zn, and max 0.25 wt. % Ti, the balance aluminum, incidental elements and impurities. The method includes providing a mold for the alloy member and injecting the alloy in semi-solid form into the mold. The alloy is solidified in the mold to provide a member having a globular microstructure contained in a lower melting eutectic matrix. The member is aged in a temperature range of about 200° to 400° F. for a period of 1 to 24 hours. Prior to aging, the member may be solution heat treated in a temperature range of 800° to 1000° F. for 0.1 to 12 hours and then quenched.

The invention also includes an improved aluminum alloy member formed from semi-solid aluminum alloy comprised of 3.5 to 5.5 wt. % Si, preferably less than 5 wt. % Si, 3.6 to 5 wt. % Cu, 0.3 to 1 wt. % Mg, max. 0.25 wt. % Fe, max. 0.1 wt. % Mn, max. 0.25 wt. % Zn, and max. 0.25 wt. % Ti, the balance aluminum, incidental elements and impurities. The member can have a maximum grain size of less than 150 $\mu$m, and a tensile strength in the range of 45 to 65 ksi and a yield strength of 40 to 55 ksi in the solution heat treated and aged condition.

DETAILED DESCRIPTION OF PREFERRED EMBODIMENTS

Figure 1:
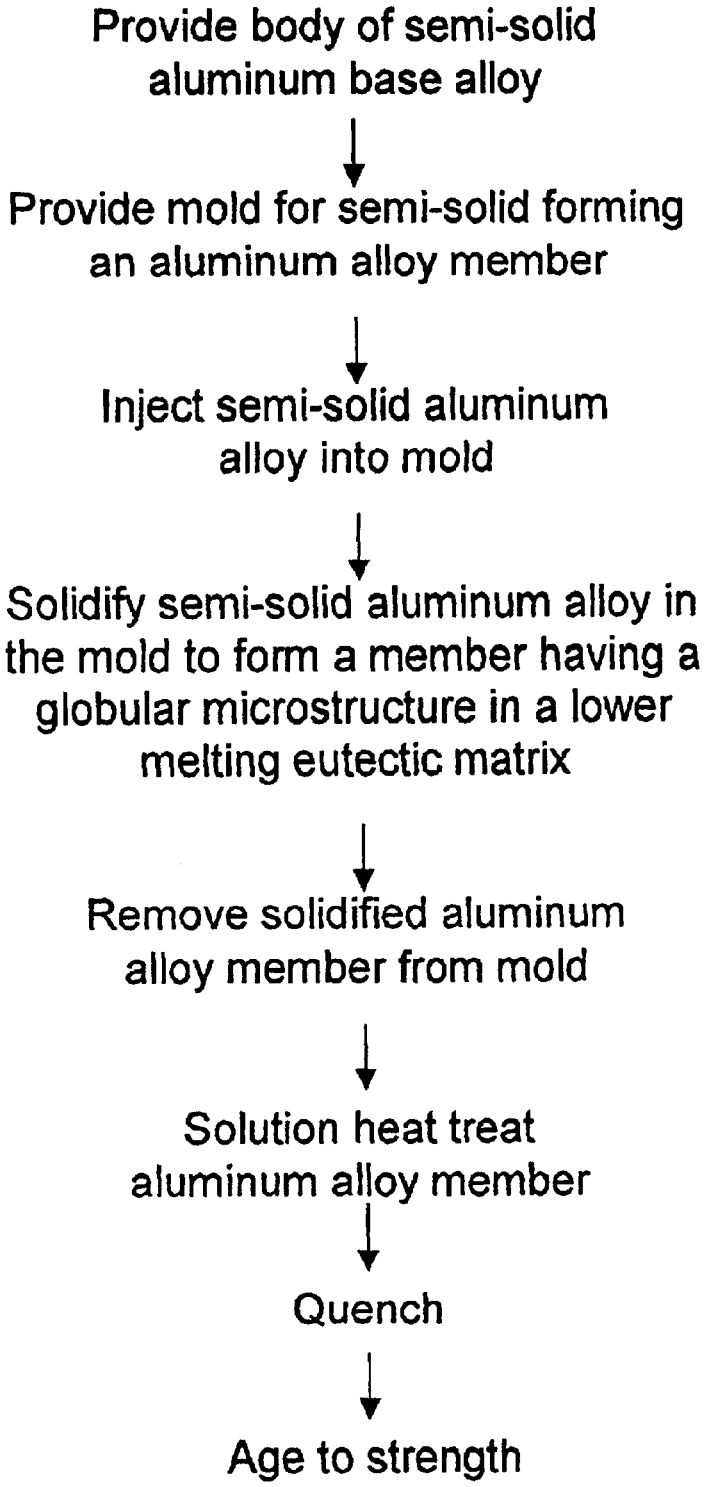
FIG. 1 is a flow chart showing steps in the invention.

Referring now to FIG. 1, there is shown a flow chart illustrating steps which can be used in the invention. In FIG. 1, a body of semi-solid aluminum base alloy is provided for forming into a member such as a vehicular or aircraft member. The semisolid aluminum base alloy may be provided from a billet or section of a billet which has been stirred during solidification or solidified in accordance with certain procedures to obtain the required globular grain structure. Sections of the billet sufficient in size to provide a member are reheated to the semi-solid state required for the forming step. This method is described in my U.S. Pat. Nos. 5,968,292; 5,846,350 and 5,571,346, incorporated herein by reference as if specifically set forth.

The body of semi-solid aluminum alloy may be provided by another method. That is, a large body of molten aluminum base alloy is provided in sufficient quantity to produce the desired members. In this process, the body of suitable aluminum base alloy is cooled to a temperature where the semi-solid condition is obtained. Quantities of the semi-solid aluminum alloy are discharged therefrom for forming into the vehicular or aircraft members. This process is described in U.S. Pat. No. 6,165,411, for example.

The semi-solid state is desirable because it is more easily formed into a shaped member. When a cast body is heated to a sufficient temperature, it transforms from a dendritic microstructure to a globular or spheroidal phase contained in a lower melting eutectic matrix and generally retains the same shape as the cast body. After transformation, the body is provided in a state resembling a thixotropic state which permits ease of forming by use of smaller forces than would be required for making a forging, for example.

Referring again to FIG. 1, it will be seen that after having obtained the semisolid body of an aluminum base alloy, a mold the shape of the desired member is provided. The semi-solid aluminum base alloy is injected into the mold and the mold is cooled or permitted to cool to provide a solidified member. Equipment for injecting semi-solid aluminum alloy into the mold on a continuous basis is illustrated in U.S. Pat. No. 6,165,411, incorporated herein by reference.

After the member is solidified in the mold, it is removed and subjected to treatments to improve strength properties. That is, the solidified member may be subject to a solution heat treatment for purposes of solutionizing soluble constituents such as magnesium, copper and silicon for a given period of time. After such heat treating, the member is quenched, preferably in water, and artificially aged for a period of time to improve strength. In certain applications where high strength is not a requirement, the member may be aged, for example, to a T5 condition without the solution heat treatment. Thereafter, the member may be machined to tolerance or otherwise finished for the final application.

The alloy of the invention is comprised of 3.5 to 5.5 wt. % Si, 3.6 to 5 wt. % Cu, 0.3 to 1 wt. % Mg, max. 0.25 wt. % Fe, max. 0.1 wt. % Mn, max. 0.25 wt. % Zn, max. 0.25 wt. % Ti and optionally at least one of the group consisting of 0.05 to 0.2 wt. % V, 0.01 to 0.05 wt. % Sr, and 0.001 to 0.005 wt. % Be, the balance comprised of aluminum, incidental elements and impurities. Preferably, the amount of Si is less than 5 wt. % and typically in the range of 3.5 to 4.9 wt. % Si. Preferably, the amount of Cu ranges from about 3.7 to 4.8 wt. % Cu. Typically, Fe will range from about 0.1 to 0.25 wt. % Fe and Ti can range from about 0.06 to 0.2 wt. % Ti.

It is important to adhere to the alloy ranges set forth herein. For example, the use of an alloy having Cu lower than 3.6 wt. %, e.g., 3.2 wt. %, can result in a member or article having lower tensile and yield strength levels. Or, if Cu is used above 5 wt. % for example, this can result in cracking during solidification. Higher levels of silicon are also detrimental because they can result in a larger grain size than desired for forming and for high strength.

If the semi-solid body of aluminum alloy is produced from billet as noted, the billet is preferably cast as described in my U.S. Pat. No. 5,968,292 and also described in U.S. Pat. Nos. 4,693,298 and 4,598,763, incorporated herein by reference.

For purposes of obtaining high tensile strengths and yield strengths, members fabricated in accordance with the present invention are preferably solution heat treated to dissolve soluble elements such as copper, magnesium and silicon which unite to form $Mg_2Si$ and $Al_2Cu$, for example, to improve tensile properties. The solution heat treatment is preferably performed in a temperature range of 800° to 1000° F., and typically in a temperature range of 900° to 980° F. The time at temperature for solution heat treatment can range from 0.1 to 12 hours. It should be noted that solution heat treatment does not interfere with the microstructure and there is no substantial loss of the globular grain structure and the resulting redevelopment of the dendritic structure. After solution heat treatment, the members are rapidly quenched using cold water, for example, to prevent or minimize uncontrolled precipitation of the strengthening phases. Quench rates of at least 50° F. per second may be used.

After the members are quenched, they are subjected to aging to improve strength. Thus, the members can be subjected to underaging or overaging treatments, including natural aging. The aging treatment may include multiple aging steps, including two or three aging steps. In two or more aging steps, the first step may include aging at a relatively high temperature followed by a lower temperature. Or, the first step may be relatively low followed by a relatively high aging step. In three-step aging, high and low combination aging steps may be employed. In single-step aging, the quenched member is held in the temperature range of 200° to 450° F., preferably 300° to 400° F. for a period sufficient to increase strength. Times for aging at these temperatures can range from 1 to 24 hours and typically 4 to 12 hours.

Members comprised of the alloy of the invention fabricated in accordance with procedures set forth herein have improved strength levels. That is, members fabricated using solution heat treatment followed by aging (T6 condition) can have tensile strengths in the range of 45 to 65 ksi and yield strengths in the range of 40 to 55 ksi. If the members are aged without solution heat treatment (T5 condition), then the tensile strength can be in the range of 35 to 50 ksi and yield strengths in the range of 25 to 35 ksi.

Typically, members in the solution heat treated and aged condition have an elongation in the range of 3 to 10% elongation and in the aged condition only (T5) in the range of 3 to 8% elongation.

Further, members of the invention have an average grain size in the range of about 60 to 100 $\mu$m with maximum grain being less than 150 $\mu$m and preferably less than 125 $\mu$m.

It is important to adhere to the ranges set forth herein for the aluminum base alloy in order to maintain the properties for members fabricated in accordance with the invention. That is, it has been discovered that outside the limits set forth, the properties, such as tensile strength, can deteriorate. For example, it was discovered that at copper levels of 3.2 wt. %, the tensile strength deteriorated rather significantly for a member tested in the T6 condition. Likewise, at silicon levels greater than 5.5 and sometimes at 5 wt. % Si or greater, the forming properties of members fabricated in accordance with the invention deteriorated because of the development of larger grain sizes.

The alloy of the invention can be used for members where high tensile strength and high yield strength are desired. For example, members as used herein can include vehicular members or parts such as automobile wheels or truck wheels and performance wheels, brake calipers, power train parts or members for automobiles or trucks, suspension parts, valve bodies, intake manifolds, and compressor connecting rods. Further, the alloy can find use in aircraft parts such as aircraft wheels.

Ranges as provided herein are meant to include all the numbers and tenths of numbers within the range as if specifically set forth.

The alloy of the invention may be used as a casting alloy for permanent mold casting, sand mold casting, die casting, squeeze or pressure casting. Further, it may be used in the F and T4 as well as the T5 and T6 tempers.

The following examples are still further illustrative of the invention.

EXAMPLE 1

An aluminum alloy containing 4.32 wt. % Si, 3.22 wt. % Cu, 0.34 wt. % Mg, 0.12 wt. % Fe, and 0.11 wt. % Ti, the balance aluminum, incidental elements and impurities, was cast into a billet 3.5 inch in diameter. The billet was cast using casting molds utilizing air and liquid coolant. The air/water coolant was adjusted in order that the body of molten aluminum was solidified at a rate of about 15 to 25° C./sec. A micrograph of a cross section of the billet showed a dendritic grain structure (see FIG. 2) and had an average grain size of about 80 $\mu$m.

Figure 3:
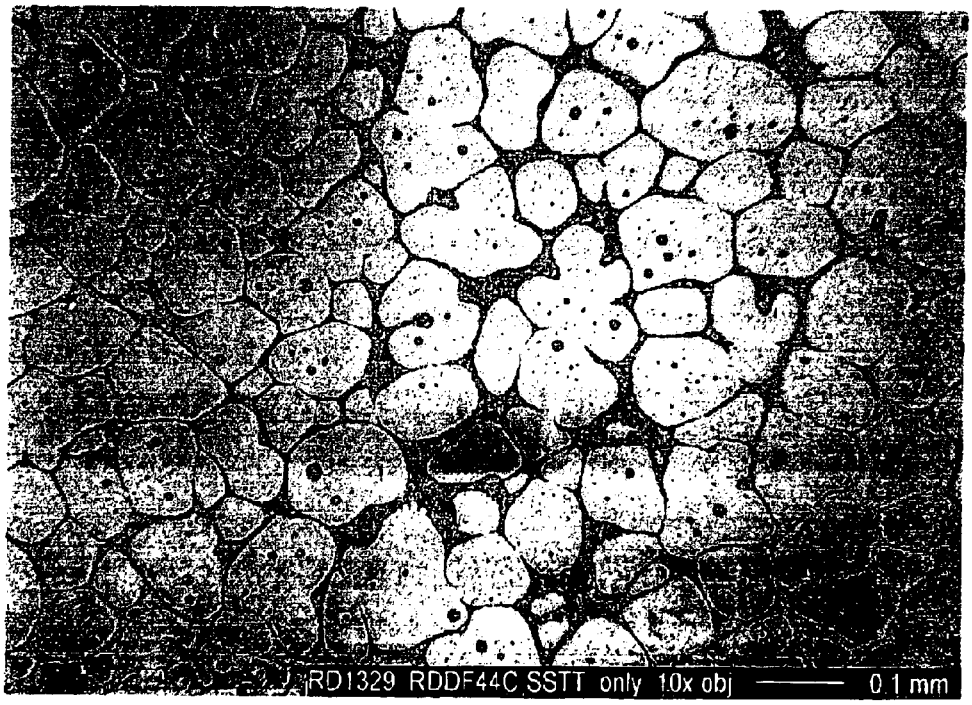
FIG. 3 is a micrograph showing the microstructure of an alloy of the invention after being thermally transformed to the globular form.

A one-inch long section of the billet was heated to 1100° F. and held at this temperature for 2 minutes until the sample was thermally transformed into globular form contained in a lower melting eutectic (FIG. 3) and then injected into a mold to form a round bar about 1⅛"×1"×4".

The round bar was then solution heat treated at 920° F. for 8 hours, quenched in cold water and artificially aged at 320° F. for 12 hours. The sample was tested and was found to have tensile strength of 49 ksi, a yield strength of 41 ksi, and an elongation of 5%. In the T5 condition (no solution heat treatment), tensile strength was 38 ksi, yield strength 28 ksi and elongation 3%.

EXAMPLE 2

In this example, the alloy contained 4.26 wt. % Si, 3.76 wt. % Cu, 0.33 wt. % Mg, 0.11 wt. % Fe, and 0.11 wt. % Ti, the balance aluminum, incidental elements and impurities. This alloy was cast and then solution heat treated, quenched and aged as in Example 1. The sample was tested and found to have a tensile strength of 61 ksi, a yield strength of 51 ksi, and an elongation of 7%. In the T5 condition (no solution heat treatment), tensile strength was 40 ksi, yield strength 29 ksi and elongation 4%.

EXAMPLE 3

Figure 2:
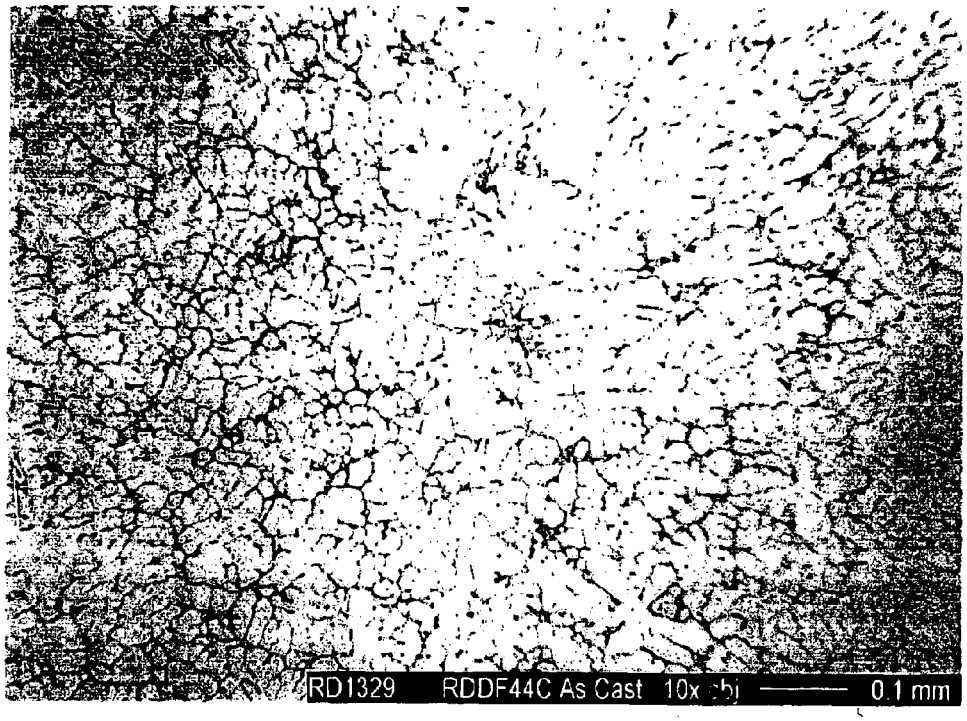
FIG. 2 is a micrograph showing the grain size of an alloy of the invention after casting.

In this example, the alloy contained 4.23 wt. % Si, 4.18 wt. % Cu, 0.33 wt. % Mg, 0.12 wt. % Fe, and 0.12 wt. % Ti, the balance aluminum, incidental elements and impurities. This alloy was cast and then solution heat treated, quenched and aged as in Example 1. The sample was tested and found to have a tensile strength of 61 ksi, a yield strength of 53 ksi, and an elongation of 6%. In the T5 condition (no solution heat treatment), tensile strength was 39 ksi, yield strength 30 ksi and elongation 4%. The microstructure of this alloy is shown in FIG. 2 in the as-cast condition and shown in FIG. 3 after semi-solid forming.

EXAMPLE 4

In this example, the alloy contained 4.23 wt. % Si, 4.18 wt. % Cu, 0.33 wt. % Mg, 0.12 wt. % Fe, and 0.12 wt. % Ti, the balance aluminum, incidental elements and impurities. This alloy was cast and then solution heat treated, quenched as in Example 1, and aged at 356° F. for 6 hours. The sample was tested and found to have a tensile strength of 63 ksi, a yield strength of 59 ksi.

Thus, it will be seen from the examples that the alloy of the invention and the processing thereof need to be carefully controlled in order to obtain the desired properties.

Having described the presently preferred embodiments, it is to be understood that the invention may be otherwise embodied within the scope of the appended claims.

What is claimed is:

1. A method of forming an aluminum base alloy member having a globular microstructure contained in a lower melting eutectic matrix, the method comprising the steps of:

(a) providing a body of a semi-solid aluminum base alloy comprising 3.5 to 4.9 wt. % Si, 3.6 to 5 wt. % Cu, 0.3 to 1 wt. % Mg, max. 0.25 wt. % Fe, max. 0.1 wt. % Mn, max. 0.25 wt. % Zn, and max. 0.25 wt. % Ti, the balance aluminum, incidental elements and impurities;

(b) providing a mold for said member;

(c) injecting said alloy in semi-solid form into said mold;

(d) cooling said mold to solidify said semi-solid base aluminum alloy to provide said cast member having a globular microstructure contained in a lower melting eutectic matrix;

(e) aging said member at a temperature in the range of 200° to 400° F. for a period of 1 to 24 hours.

2. The method in accordance with claim 1 wherein said alloy optionally includes at least one of the elements from the group consisting of 0.05 to 0.2 wt. % V, 0.01 to 0.05 wt. % Sr and 0.001 to 0.005 wt. % Be.

3. The method in accordance with claim 1 wherein said alloy contains 0.01 to 0.05 wt. % Sr.

4. The method in accordance with claim 1 wherein said member in the T5 condition has an elongation in the range of 3 to 8%.

5. The method in accordance with claim 1 wherein said member in the T5 condition has a tensile strength in the range of 35 to 50 ksi and a yield strength of 25 to 35 ksi.

6. The method in accordance with claim 1 wherein said member in the T6 condition has a tensile strength in the range of 45 to 65 ksi and a yield strength of 40 to 55 ksi.

7. The method in accordance with claim 1 including the step of solution heat treating said member prior to said aging step.

8. The method in accordance with claim 1 including solution heat treating said member at a temperature in the range of 800° to 1000° F. for a period of 0.1 to 12 hours ta provide a solution heat treated member.

9. The method in accordance with claim 1 including quenching said solution heat treated member prior to aging.

10. The method in accordance with claim 1 wherein said quenching is a cold water quench.

11. The method in accordance with claim 1 wherein said alloy contains 3.9 to 4.9 wt. % Si and 3.7 to 4.8 wt. % Cu.

12. A method of forming an aluminum base alloy formed member having a globular microstructure contained in a lower melting eutectic matrix, the method comprising the steps of:

(a) providing a body of a semi-solid aluminum base alloy comprising 3.5 to 49 wt. % Si, 3.6 to 5 wt. % Cu, 0.3 to 1 wt. % Mg, max. 0.25 wt. % Fe, max. 0.1 wt. % Mn, max. 0.25 wt. % Zn, and max. 0.25 wt. % Ti, the balance aluminum incidental elements and impurities;

(b) providing a mold for said member;

(c) injecting said alloy in semi-solid form into said mold;

(d) solidifying said semi-solid base aluminum alloy in said mold to provide said formed member having a globular microstructure contained in a lower melting eutectic matrix;

(e) solution heat treating said member in a temperature range of 800° to 1000° F. for a period of 0.1 to 12 hours to provide a solution heat treated member;

(f) quenching said solution heat treated member to provide a quenched member; and (g) aging said quenched member to provide an aged member having a tensile strength in the range of 45 to 65 ksi and a yield strength in the range of 40 to 55 ksi.

13. The method in accordance with claim 12 wherein the alloy contains 3.5 to 4.9 wt. % Si and 3.7 to 4.8 wt. % Cu.

14. A method of forming an aluminum base alloy formed member having a globular microstructure contained in a lower melting eutectic matrix, the method comprising the steps of:

(a) providing a body of a semi-solid aluminum base alloy comprising 3.5 to 4.9 wt. % Si, 3.7 to 4.8 wt. % Cu, 0.3 to 1 wt. % Mg, max. 0.25 wt. % Fe, max. 0.1 wt. % Mn, max. 0.25 wt. % Zn, and max. 0.25 wt. % Ti, the balance aluminum, incidental elements and impurities;

(b) providing a mold for said member;

(c) injecting said alloy in semi-solid form into said mold;

(d) solidifying said semi-solid base aluminum alloy in said mold to provide said formed member having a globular microstructure contained in a lower melting eutectic matrix; and (e) aging said member to provide an aged member having a tensile strength in the range of 45 to 65 ksi and a yield strength in the range of 40 to 55 ksi in the T6 condition.

* * * * *